United States Patent [19]

Papesh

[11] Patent Number: 4,782,687

[45] Date of Patent: Nov. 8, 1988

[54] POWER TOOL FOR AUTO BODY REPAIR

[76] Inventor: Thomas S. Papesh, 1809 N. Center St., Crest Hill, Ill. 60435

[21] Appl. No.: 940,897

[22] Filed: Dec. 12, 1986

[51] Int. Cl.[4] ..... B21D 1/12

[52] U.S. Cl. ..... 72/409; 72/705; 254/93 R; 294/106

[58] Field of Search ..... 72/302, 409, 410, 705, 72/392, 422; 29/221, 223, 232; 24/463; 254/29 R, 93 R; 81/301, 324; 269/30, 32, 34, 237, 238; 294/97, 111, 110.1, 112, 106, 118

[56] References Cited

U.S. PATENT DOCUMENTS

| | | | |
|---|---|---|---|
| 1,623,405 | 4/1927 | Gocke et al. | 72/392 |
| 1,837,690 | 12/1931 | Sunde | 72/392 |
| 2,114,531 | 4/1938 | Harvey | 72/409 |
| 2,283,089 | 5/1942 | Pfauser | 72/705 |
| 2,594,503 | 4/1952 | Sanderson | 269/238 |
| 2,747,535 | 5/1956 | Curry | 269/34 |
| 3,140,547 | 7/1964 | Blommel | 254/98 |
| 3,432,159 | 3/1969 | Rakatansky | 269/238 |
| 3,696,653 | 10/1972 | Mojelski | 72/705 |
| 3,834,215 | 9/1974 | Lemley | 81/301 |
| 4,262,588 | 4/1981 | McDonald | 72/409 |
| 4,502,316 | 3/1985 | Japhet | 72/392 |

FOREIGN PATENT DOCUMENTS

| | | | |
|---|---|---|---|
| 1197992 | 12/1985 | U.S.S.R. | 254/98 |
| 1324709 | 7/1973 | United Kingdom | 72/392 |

*Primary Examiner*—Lowell A. Larson
*Attorney, Agent, or Firm*—Ernest Kettelson

[57] ABSTRACT

A power tool for auto body repair in accordance with this invention, including several species or embodiments of this invention, comprises a small hydraulic ram which may be as small as two inches or less in height, width and length with a reciprocating piston or ram having a travel of less than an inch between its extended position and its retracted position. One embodiment of the tool includes an iron to press out wrinkles in metal auto body parts, comprising a pair of pivotally joined levers each having a press plate at the working end, pivotal between an open position to receive a wrinkled auto body part and a closed position to iron or press out the wrinkles, the small hydraulic ram being positioned between the opposite or power end of the levers to force the working end to its closed pressing position when the hydraulic piston or ram is moved toward its extended position. A second embodiment of the tool includes a puller to straighten a bent auto body part by pulling, wherein each of the levers at the working end of the tool include a jaw member having a gripping surface to tightly hold an end portion of an auto body part when the hydraulic ram is moved toward its extended position, such puller tool including cooperative hook means for hooking to a chain connected to a power source which pulls and thus straightens the auto body part.

6 Claims, 8 Drawing Sheets

POWER TOOL FOR AUTO BODY REPAIR

BACKGROUND OF THE INVENTION

This invention relates to the field of power tools for use in making auto body repairs, in particular to iron or press out wrinkles in metal auto body parts, to straighten such parts by pulling, and to remove dents therein by pushing from the opposite side. The invention relates to that part of auto body repair in which relatively small areas of the auto body parts have to be dealt with individually to remove relatively small wrinkles, bends and dents.

Prior art methods for removing these relatively smaller wrinkles, bends and dents include the use of hammers, pry bars and other types of hand tools. It is very difficult to completely smooth out all wrinkles, bends and dents by use of such tools, so it is then necessary to use filler materials such as bondo, epoxy and the like in order to restore a completely smooth surface.

The present invention solves such problems by providing a power tool for repair of relatively small areas of body parts in which a small hydraulic ram is mounted on the tool and its various embodiments, giving such tool sufficient power to iron out wrinkles, to grip for straightening by connection to a powered pulling source, and to press out dents, all by a slow, smooth, continuously applied force rather than by repeated impacts of a hammer or repeated repositioning of pry bars and the like. The slow, smooth, continuously applied force can be applied with enough precision to restore the damaged auto body part to its original shape, or close enough to its original shape to make the use of filler materials unnecessary in most cases where such fillers would be required when existing prior art methods of such auto body repair are used.

SUMMARY OF THE INVENTION

It is an object of the invention to provide a power tool for auto body repair in which a powered ram is mounted on the tool to provide a source of precisely controllable power to the working portion of such tool.

It is an object of the invention to provide a power tool for auto body repair which is portable and useable to remove wrinkles, bends and dents from relatively small areas of auto body parts.

It is an object of the invention to provide a power tool for auto body repairs having a pair of press plates to iron or press out wrinkles of an auto body part placed between such press plates, wherein a powered ram on such tool supplies the force to press such press plates together.

It is an object of the invention to provide a power tool for auto body repairs having a pair of gripping jaws to grip a portion of an auto body part for pulling to straighten a bend therein, wherein a powered ram on such tool supplies the force to press such gripping jaws together.

It is an object of the invention to provide a power tool for auto body repairs having an enlarged flat surface press plate to push against the opposite side of a dent in an auto body part for removal of such dent, wherein a powered ram on such tool supplies the force to push such press plate for removal of such dent.

It is an object of the invention to provide a portable power tool for auto body repairs having a powered ram powered by a hydraulic power source.

It is an object of the invention to provide a portable power tool for auto body repairs having a powered ram powered by a pneumatic power source.

DESCRIPTION OF PREFERRED EMBODIMENT

Figure 1:
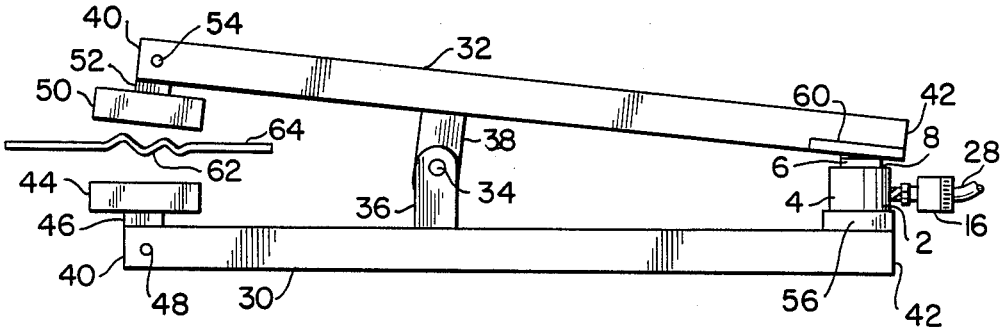
FIG. 1 is a side elevation view of a power tool for auto body repairs in accordance with this invention having a pair of press plates at its working end shown in the open position to receive a wrinkled portion of a damaged auto body part.

A power tool in accordance with the present invention includes a small power ram 2, which is preferably a hydraulic ram but which may be pneumatic or powered by other means. The power source is one that is able to apply substantial force in a manner which can be precisely controlled, preferably slow, smooth and continuous until stopped. The hydraulic ram 2 which is shown and described herein has a power capacity of five tons. It is small enough to be used with power tools in accordance with this invention which are portable and useable to remove wrinkles, bends and dents from relatively small damaged areas of auto body parts. For such purpose, a desirable size for the hydraulic ram 2 as shown and described herein is a body length of about two inches, a body width of about one and five-eighths inches, and travel distance of the piston or ram of about five-eighths of an inch between its fully retracted and fully extended positions.

The hydraulic ram 2 includes the body portion 4, piston 6 which extends from and retracts into the front end wall 8 of body portion 4, hydraulic port 10 through side wall 12 opening to the hydraulic cylinder 14, and coupling unit 16 threaded in place in hydraulic port 10. The body portion 4 is further bounded by top wall 18, opposite side wall 20, bottom wall 22 and rear end wall 24.

The hydraulic ram 2 is connected to hand operated hydraulic pump 26 by a quarter inch hose 28.

Figure 2:
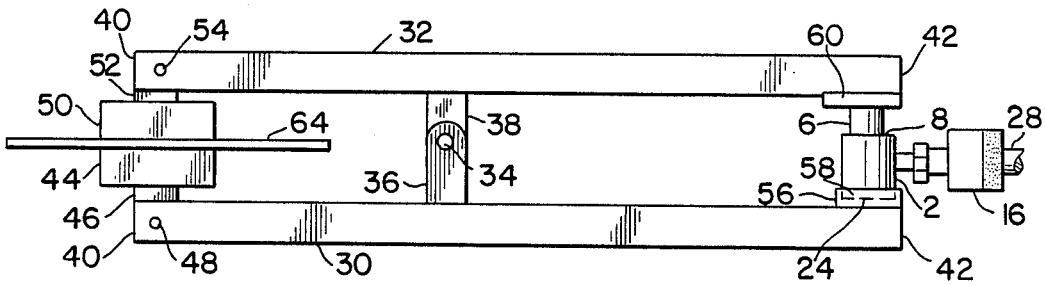
FIG. 2 is a side elevation view of the power tool of FIG. 1 with the pair of press plates shown in the closed position.

The embodiment of the invention shown in FIGS. 1 and 2, includes a pair of levers 30 and 32 approximately twenty inches in length but which may be somewhat longer or somewhat shorter in side-by-side relationship, pivotally joined together by pivot pin 34 through connecting links 36 and 38 positioned at an intermediate location of the levers inwardly from their working end 40 and their powered end 42.

At the working end 40, a press plate 44 is connected to lever 30 by extension 46 extending inwardly from the working end 40 of lever 30 and substantially normal thereto. Extension 46 may be pivotally connected to lever 30 by pivot pin 48 as shown, but it could also be integrally or rigidly connected. A press plate 50 is connected to lever 32 by extension 52 extending inwardly from the working end 40 of lever 32 and substantially normal thereto. Extension 52 may be pivotally connected to lever 32 by a pivot pin 54 as shown, but it could also be integrally or rigidly connected.

The dimensions of the press plates as shown and described herein are approximately two and one-half inches square and about three-quarters of an inch thick.

The press plates 44 and 50 are pivotally movable between an open position as shown in FIG. 1 by moving the powered end 42 of levers 30 and 32 toward each other, and a closed position as shown in FIG. 2 by moving the powered ends 42 of levers 30 and 32 away from each other.

The powered end 42 of lever 30 includes a pocket 56 having a recess 58 of cross-sectional dimension and configuration corresponding to that of rear end wall 24 of the hydraulic ram 2 to receive and hold the hydraulic ram 2 therein with its front end wall 8 and piston or ram 6 facing pressure plate 60 on the powered end 42 of lever 32. When hydraulic pressure is applied to move the piston or ram 6 from its retracted to its extended position, the piston or ram 6 bears against the pressure plate 60 on lever 32 forcing the powered ends 42 apart thereby pivotally forcing the press plates 44 and 50 at the working end 40 together under five tons of applied pressure. The wrinkled portion 62 of damaged auto body part 64 is thereby smoothed out, or ironed, removing the wrinkles and substantially restoring to its original shape. The pressure plates 60 have an enlarged lateral surface area which is greater than the corresponding lateral surface area of the powered ends 42 of levers 30 and 32 to provide a broader contact area for the ram 6 to bear against.

All parts of the tool as described are preferably of steel or of other metal strong enough to withstand five tons of applied pressure without bending or breaking.

Figure 3:
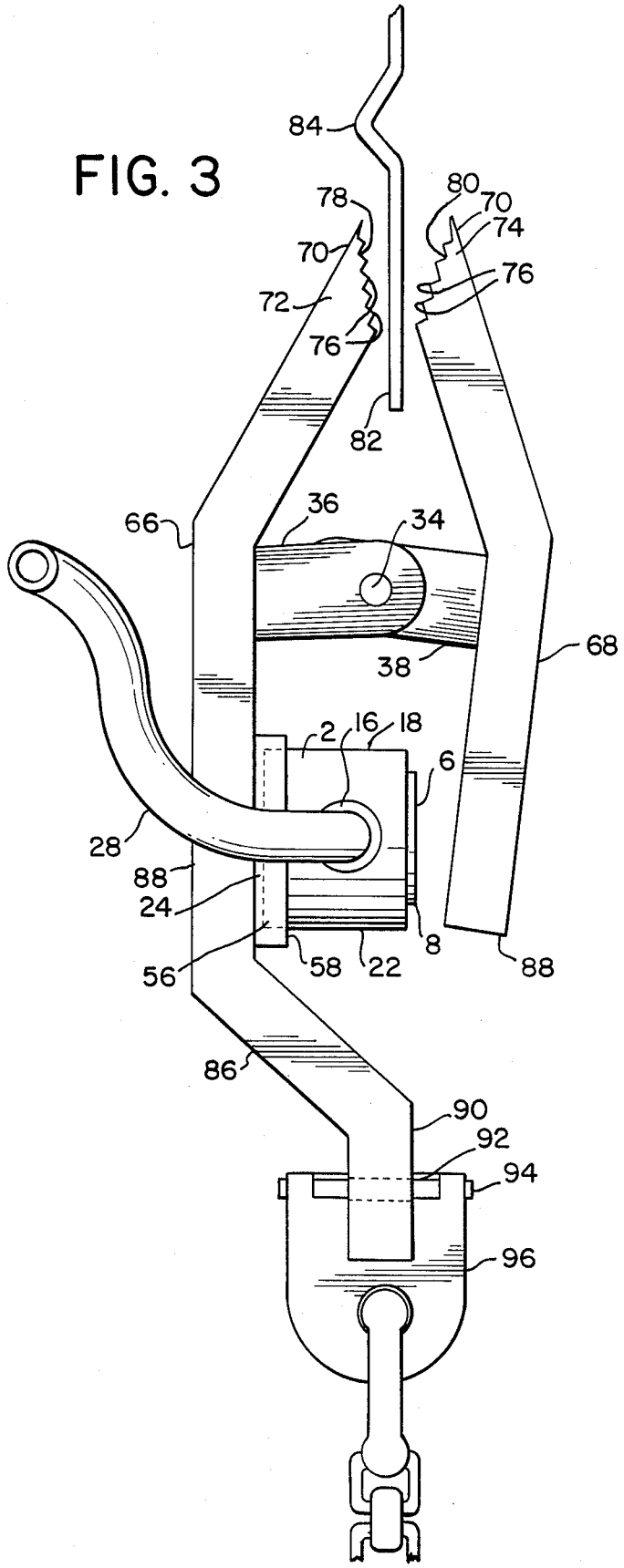
FIG. 3 is a side elevation view of a power tool in accordance with this invention having a pair of gripping jaws at its working ends shown in the open positions to receive an end portion of a bent auto body part for straightening by pulling.
Figure 4:
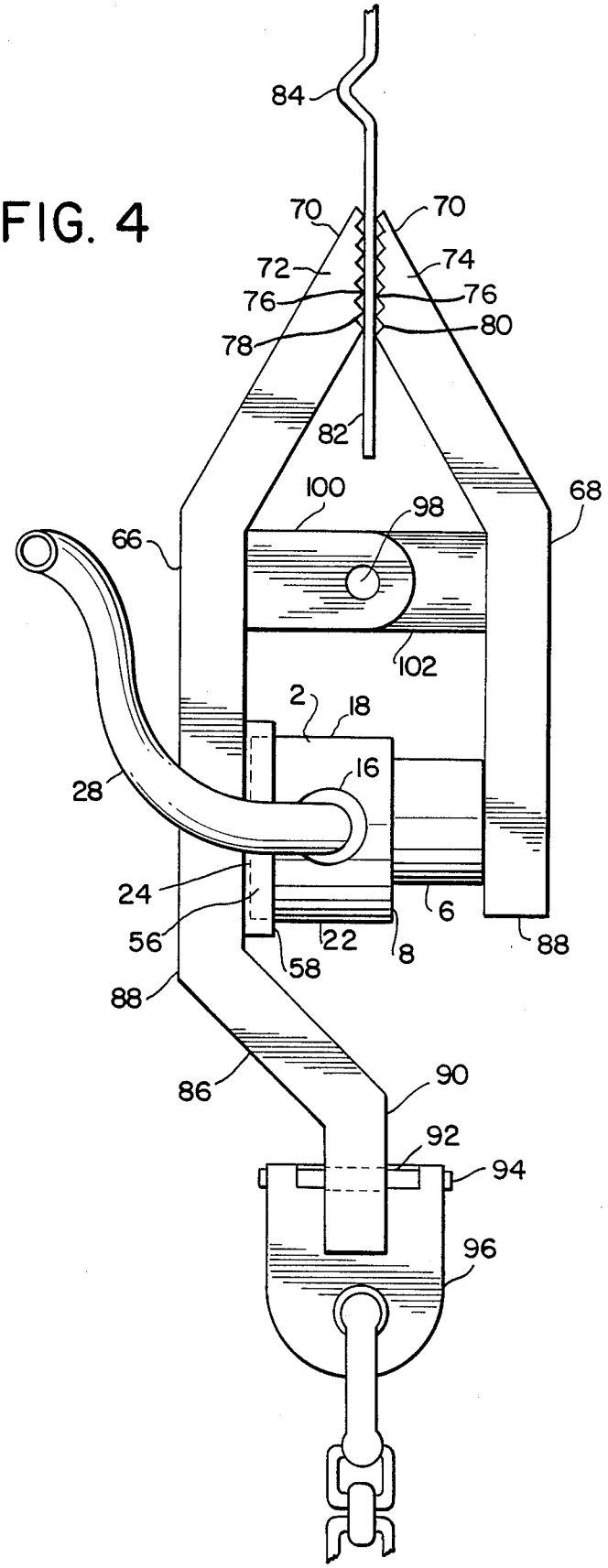
FIG. 4 is a side elevation view of the power tool of FIG. 3 with the pair of gripping jaws shown in the closed position.

The embodiment of the invention shown in FIGS. 3 and 4, includes a pair of levers 66 and 68 in side-by-side relationship, approximately four inches in length, terminating at the working end 70 in a pair of gripping jaw members 72 and 74 having teeth 76 or other grip enhancing means projecting from the abutting gripping surfaces 78 and 80 thereof. The levers 66 and 68 may be somewhat longer or somewhat shorter than four inches, but of a size which is conviently portable by a workman. The width of levers 66 and 68, and of jaw members 72 and 74 is preferably in the range of two inches to four inches to provide sufficient strength and a broad gripping surface to effectively grip and hold a rearward portion 82 of a bent auto body part 84 while a pulling force is applied to the tool sufficient to straighten the bent portion by pulling.

Lever 66 includes an angled extension 86 integrally joined to its powered end 88, extending at a diagonal in the direction toward lever 68 or an extension thereof, the angled extension 86 terminating in a connecting stub 90 which extends in a direction substantially parallel to lever 66 and the central axis of which is substantially coplanar with the gripping surface 78 so that pulling force from connecting stub 90 is substantially in axial alignment with the gripping surfaces 78 and 80 when in the closed gripping position with portion 82 of auto body part 84 gripped therebetween. Connecting stub 90 includes an aperture 92 extending transversely therethrough to receive a connecting pin 94 and clevis 96 in which a chain may be connected for pulling to straighten the bent auto body part 84.

The levers 66 and 68 are pivotally joined together by pivot pin 98 through connecting links 100 and 102 positioned adjacent forward ends of levers 66 and 68.

The powered end 88 of lever 66 may include pocket 56 to receive the rear end portion of hydraulic ram 2 in its recess 58. The front end wall 8 and piston or ram 6 then faces the powered end 88 of lever 68, and since the levers 66 and 68 of this tool embodiment are relatively broad, i.e. between two to four inches for example, no special pressure plate on lever 68 is required for the piston or ram 6 to bear against. When hydraulic pressure is applied to move the piston or ram 6 from its retracted to its extended position, the piston or ram 6 bears against the powered end 88 of lever 68 forcing the powered ends 88 apart thereby pivotally forcing the gripping jaw members 72 and 74 at the working end 70 together under five tons of applied pressure. The rearward portion 82 of bent auto body part 84 is thereby securely gripped by the tool firmly enough to hold while sufficient pulling pressure is applied to straighten the bent auto body part 84 by a chain connected at one end to the clevis 96 and at its opposite end to a separate pulling force.

All parts of the embodiment of the tool shown in FIGS. 3 and 4 and described above are preferably of steel or of other metal strong enough to withstand five tons of applied pressure without bending or breaking.

Figure 5:
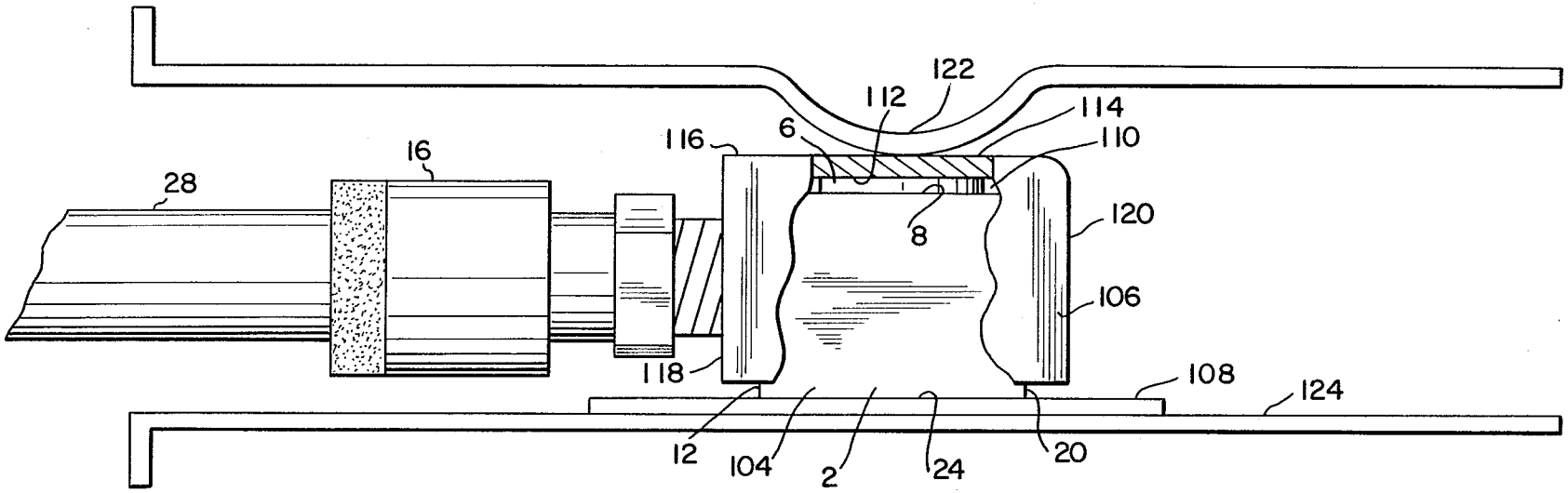
FIG. 5 is a side elevation view of a power tool in accordance with this invention having a pair of telescoping sections reciprocally movable between an extended and retracted position having flat surface press plates at the outer end of each telescoping section, shown in the retracted position and positioned to push out a dent in an auto body part, a portion of the outer and forward telescoping section broken away.
Figure 6:
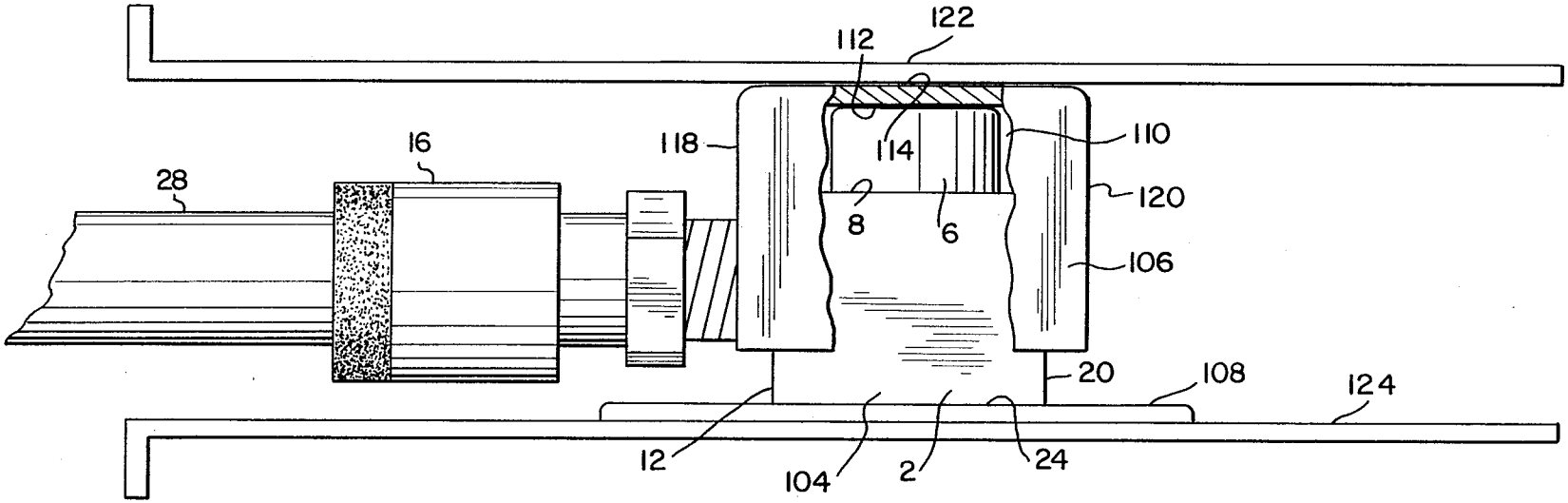
FIG. 6 is a side elevation view of the power tool of FIG. 5 with the pair of telescoping sections shown in the extended position.
Figure 7:
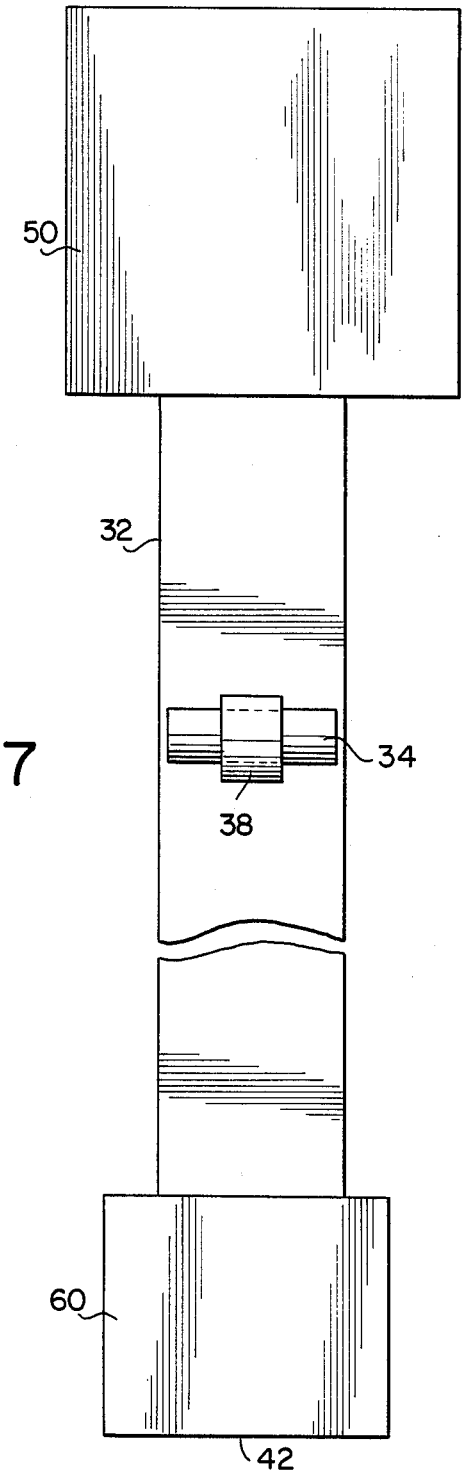
FIG. 7 is a plan view of one of the tool members for use with the tool as shown in FIG. 1.

The embodiment of the invention shown in FIGS. 5 and 6, includes a pair of telescoping sections 104 and 106. Telescoping section 104 as shown and described herein may comprise the hydraulic ram 2 to which a rear pressure plate 108 has been connected across its rearward end wall 24, the pressure plate 108 having a broader abutting surface than end wall 24 of the hydraulic ram 2. The front end wall 8 of hydraulic ram 2, and its piston or ram 6 are positioned to enter and telescope into the cavity 110 of the outer and forward telescoping section 106, and to face the inner surface of forward pressure plate 112 at the working end 114 of the telescoping section 106 for engagement thereagainst when the piston or ram 6 is moved toward its extended position. The top wall 116 of telescoping section 106 is slightly wider than the front end wall 8 of hydraulic ram 2 on which it rests thereby spacing side wall 118 of telescoping section 106 apart from adjacent side wall 12 of hydraulic ram 2 and side wall 120 of telescoping section 106 apart from adjacent side wall 20 of hydraulic ram 2 far enough to enable telescoping section 106 to slide freely relative to hydraulic ram 2 which comprises telescoping section 104 when the piston or ram 6 is moved toward its extended position thereby forcing telescoping section 106 outwardly from telescoping section 104.

The side wall 118 of telescoping section 106 includes an enlarged open portion 122 for the coupling unit 16, connected to hydraulic port 10 through side wall 12 of hydraulic ram 2, to extend through for connection to a hydraulic pump and to permit the forward telescoping section 106 to move forward relative to hydraulic ram 2 comprising the rearward telescoping section 104.

The bottom wall of telescoping section 106 may be open, or it may be partially enclosed to more securely retain the hydraulic ram 2 slidingly received in the cavity 110 of telescoping section 106.

This telescoping embodiment of the tool may be used to push against the opposite side of a dented auto body part 122, by placing the forward pressure plate 112 thereagainst and the rearward pressure plate 108 against an appropriate anchor or base, such as a spaced apart undamaged auto body part 124. An example is an elongated rail member of an auto having a square cross-section with spaced apart peripheral walls defining a square cross-section cavity therein, wherein one of the peripheral walls has been dented while its opposite facing wall is undamaged. The cavity is large enough to insert the telescoping embodiment of the tool therein, with the hydraulic hose 28 connected which can then be used to push the unit far enough into the cavity of the hollow rail member to reach the dented portion. If necessary, metal shims can be placed between the forward end of the piston or ram 6 and the inner surface of the forward pressure plate 112, for example if the opposed walls of the rail member are farther apart than most typical rail members or if additional travel distance of the ram 6 is required in order to completely push out the dent. With the rearward pressure plate 108 against the undamaged wall 124 of the rail member and the forward pressure plate 112 against the inner surface of the dented portion 122, hydraulic pressure is applied to force the piston or ram 6 toward its extended position thereby pushing the forward pressure plate 112 against the dented portion until the dent has been removed and the side wall of the rail member is substantially restored to its original position.

Figure 8:
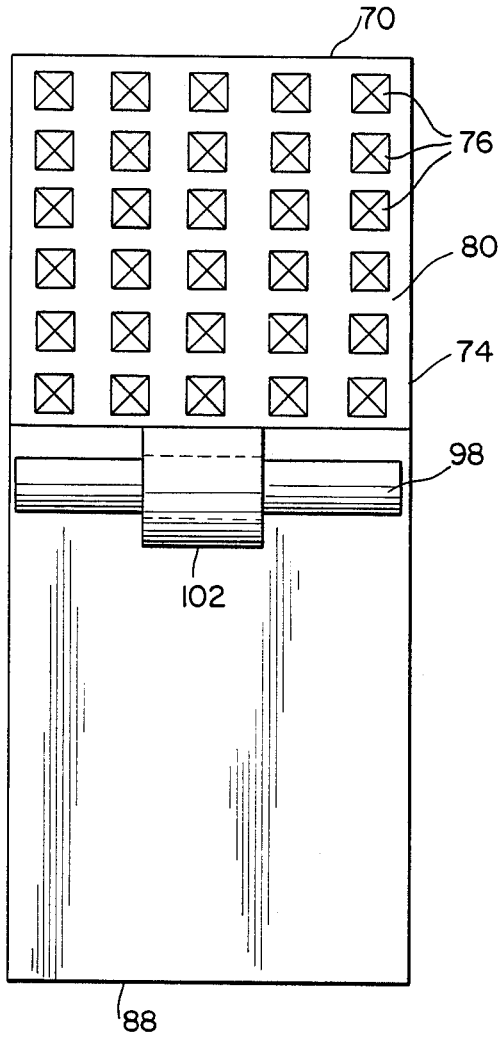
FIG. 8 is a plan view of one of the tool members for use with the tool as shown in FIG. 3.
Figure 9:
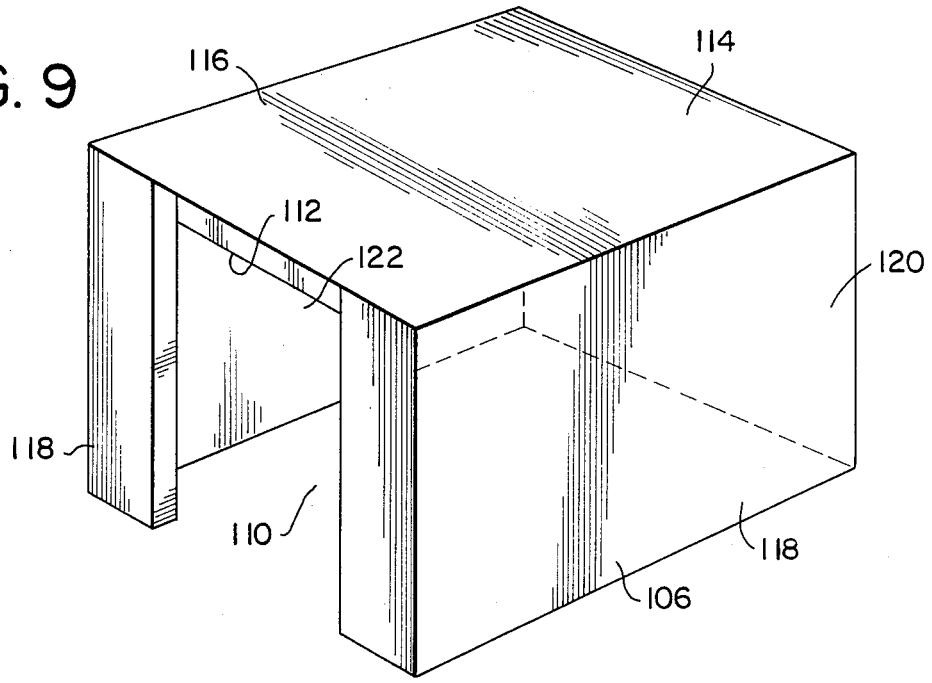
FIG. 9 is a perspective view of the outer and forward telescoping section of the tool as shown in FIG. 5.
Figure 10:
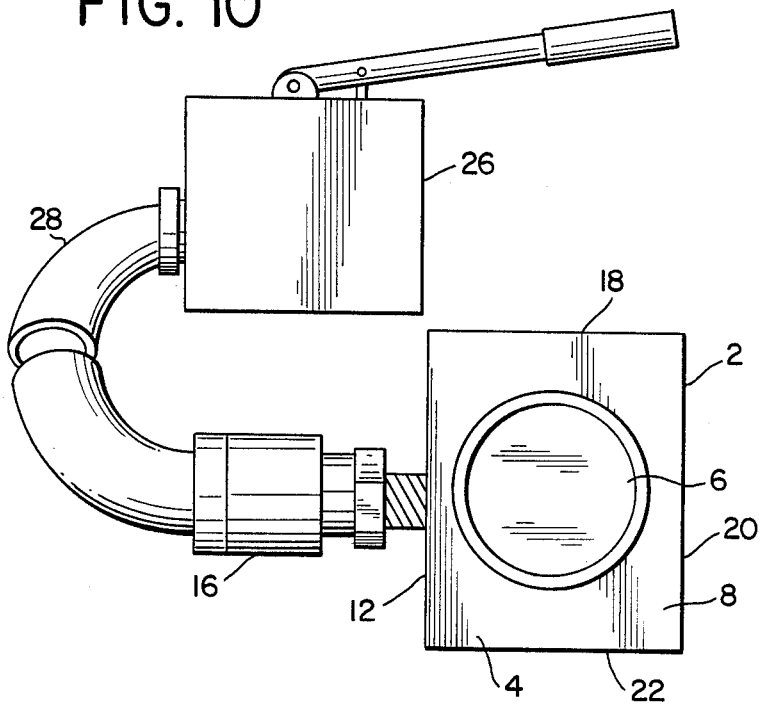
FIG. 10 is a top plan view of the small hydraulic ram for use with a power tool in accordance with this invention, connected to a hand operated hydraulic pump.
Figure 11:
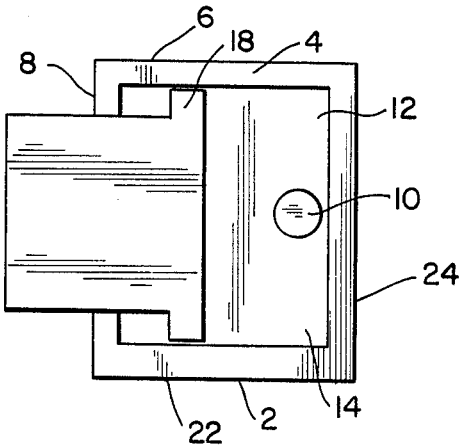
FIG. 11 is a side elevation view of the small hydraulic ram of FIG. 10, with a portion broken away to show the hydraulic port, hydraulic cylinder, and hydraulic piston or ram.

The gripping surfaces 78 and 80 of jaw members 72 and 74 of the tool shown in FIGS. 3 and 4 are relatively broad, and may be substantially the same dimension laterally as longitudinally as shown in FIG. 8. The elongated levers 66 and 68 are preferably the same broad width throughout from their jaw members 72 and 74 at their working ends 70 to their powered ends 88. This provides greater structural strength enabling the application of greater force at the powered ends 88 to thereby provide greater gripping force of the jaw members 72 and 74 at the working ends 70. The relatively broad elongated levers 66 and 68 throughout from their working ends 70 to their powered ends 88 also provides a broad mounting surface for the powered ram 2 on the powered end 88 of lever 66 and a broad pressure plate surface on the powered end 88 of lever 68 whereby no separate pressure plate is required.

I claim:

1. A power tool for auto body repair comprising a first tool member and a second tool member movable between a working position and a non-working position, a powered reciprocating ram positioned on said first tool member for contact with said second tool member to move it to said working position, said powered reciprocating ram being movable between a retracted and an extended position for contact with said second tool member when in said extended position, and a power source to power said reciprocating ram, wherein said powered reciprocating ram includes a small compact body having a length, width and height each of which is greater in dimension than the longitudinal length of travel of said ram between said retracted position and said extended position, said reciprocating ram having an outwardly facing planar free end, said planar free end having a broad flat bearing surface, said first tool member on which said ram is positioned having a broad planar positioning surface, said second tool member having a broad planar contact surface, said broad flat bearing surface of said planar free end of said reciprocating ram being in full face bearing contact with said broad planar contact surface of said second tool member and substantially coplanar therewith when said ram is in said extended position, wherein said power tool comprises a tool to grip a portion of a bent auto body part for straightening by pulling force applied to said tool in a direction away therefrom and axially aligned with a straight line coincident with the longitudinal axis of said bent auto body part when straightened, said first tool member comprising a first elongated lever having a working end and an opposite powered end, said broad planar positioning surface of said first tool member being on said powered end thereof, said second tool member comprising a second elongated lever having a working end and a powered end, said broad planar contact surface of said second tool member being on said powered end thereof, coupling means to couple said first elongated lever to said second elongated lever whereby said working ends thereof are moved toward said working position when said powered ends thereof are moved in one direction relative to each other, said powered reciprocating ram positioned on said first tool member comprising said first elongated lever being operative to move said powered ends in said one direction relative to each other, a first jaw member on said working end of said first elongated lever, a second jaw member on said working end of said second elongated lever, said jaw members each having a planar gripping surface facing toward each other, each having gripping means projecting therefrom for gripping a portion of an auto body part for pulling thereon when said first and second elongated levers are moved to their said working position, said planar free end of said reciprocating ram then being substantially coplanar with said planar contact surface of said second tool member, and an integrally formed connecting extension member extending from said powered end of one of said elongated levers for connection of a chain thereto, the other of said elongated levers terminating at said powered end thereof.

2. A power tool for auto body repair as set forth in claim 1, wherein said first elongated lever is in side-by-side, spaced apart relationship to said second elongated lever, said coupling means including a first projection extending from said first elongated lever toward said second elongated lever and terminating in a free end, a second projection extending from said second elongated lever toward said first elongated lever and terminating in a free end which overlaps the said free end of said first projection, and pivot means connecting said free ends of said first and second projection together whereby said working ends of said first and second elongated levers are pivotally moved toward their said working position when said powered ends thereof are moved apart and said working ends are moved toward their said non-working position when said powered ends are moved toward each other.

3. A power tool for auto body repair as set forth in claim 2, wherein said pivot means includes a first aperture through said first projection adjacent said free end thereof, a second aperture through said second projection adjacent said free end thereof, said second aperture being in registration with said first aperture, and a pivot pin through said first and second apertures.

4. A power tool for auto body repair as set forth in claim 1, wherein said gripping surfaces of said jaw members are relatively broad, their lateral dimension being substantially equal to their longitudinal dimension, said gripping means including teeth spaced apart and close together throughout the entire surface area of said gripping surfaces and projecting outwardly therefrom.

5. A power tool for auto body repair as set forth in claim 4, wherein said first and second elongated levers have a uniform lateral dimension throughout from their said working ends to their said powered ends substantially equivalent to said lateral dimension of said jaw members.

6. A power tool for auto body repair comprising a first tool member and a second tool member movable between a working position and a non-working position, a powered reciprocating ram positioned on said first tool member for contact with said second tool member to move it to said working position, said powered reciprocating ram being movable between a retracted and an extended position for said contact with said second tool member when said ram is in said extended position, and a power source to power said reciprocating ram, wherein said power tool comprises a tool to grip a portion of a bent auto body part for straightening by pulling force applied to said tool in a direction away therefrom and axially aligned with a straight line coincident with the longitudinal axis of said bent auto body part when straightened, said first tool member comprising a first elongated lever having a working end and an opposite powered end, said second tool member comprising a second elongated lever having a working end and a powered end, coupling means to couple said first elongated lever to said second elongated lever whereby said working ends thereof are moved toward said working position when said powered ends thereof are moved in one direction relative to each other, said powered reciprocating ram positioned on said tool member comprising said first elongated lever being operative to move said powered ends in said one direction relative to each other, a first jaw member on said working end of said first elongated lever, a second jaw member on said working end of said second elongated lever, said jaw members each having a gripping surface facing toward each other, each having a gripping means projecting therefrom for gripping a portion of an auto body part for pulling thereon when said first and second elongated levers are moved to their said working position, and an integrally formed connecting extension member extending from said powered end of one of said elongated levers for connection of a chain thereto, the other of said elongated levers terminating at said powered end thereof, wherein a first end of said connecting extension member is integrally joined to and extends from said powered end of said first elongated lever, said connecting member extends at a diagonal therefrom and terminates at a second opposite end, a connecting stub member having its longitudinal axis substantially coplanar with said gripping surface of said first jaw member of said first elongated lever, one end of said connecting stub member being integrally joined with said diagonally extending connecting extension member at said second end thereof, said connecting stub member extending from said second end of said diagonally extending connecting extension member and terminating at a free end, and coupling means to couple said free end of said connecting stub member of said power tool to a pulling power source.

* * * * *